US009601059B2

(12) United States Patent
Foo et al.

(10) Patent No.: US 9,601,059 B2
(45) Date of Patent: Mar. 21, 2017

(54) DYNAMIC BACKLIGHT CONTROL SELECTOR

(75) Inventors: Ken Foo, Sunnyvale, CA (US); Kevin Tom, San Francisco, CA (US)

(73) Assignee: Google Inc., Mountain View, CA (US)

( * ) Notice: Subject to any disclaimer, the term of this patent is extended or adjusted under 35 U.S.C. 154(b) by 338 days.

(21) Appl. No.: 13/472,418

(22) Filed: May 15, 2012

(65) Prior Publication Data

US 2015/0206480 A1 Jul. 23, 2015

(51) Int. Cl.
*G09G 3/34* (2006.01)

(52) U.S. Cl.
CPC ... *G09G 3/3406* (2013.01); *G09G 2320/0646* (2013.01); *G09G 2320/103* (2013.01); *G09G 2330/021* (2013.01); *G09G 2360/16* (2013.01)

(58) Field of Classification Search
CPC ..... G09G 3/3406; G09G 2330/021; G09G 2360/16; G09G 2320/103; G09G 2320/0646
USPC ..... 345/102; 315/307; 349/61–71
See application file for complete search history.

(56) References Cited

U.S. PATENT DOCUMENTS 7,161,577 B2 * 1/2007 Hirakata ..... G09G 3/342 345/102
2002/0047818 A1 * 4/2002 Yamamoto ..... G09G 3/342 345/87
2002/0154088 A1 * 10/2002 Nishimura ..... G09G 3/342 345/102
2003/0030618 A1 * 2/2003 Jones ..... G09G 3/3611 345/102
2005/0212737 A1 * 9/2005 Yoshihara ..... G09G 3/3406 345/87
2006/0192784 A1 * 8/2006 Yamaji ..... G11B 27/02 345/473
2006/0227125 A1 10/2006 Wong et al.
2006/0239574 A1 * 10/2006 Brower ..... H04N 19/63 382/240
2007/0279369 A1 12/2007 Yao et al.
2008/0042954 A1 * 2/2008 Lee ..... G09G 3/3406 345/89
2008/0309610 A1 * 12/2008 Yoshida ..... G09G 3/3406 345/102
2009/0070606 A1 3/2009 Chen et al.
2009/0121655 A1 * 5/2009 Kojima ..... G09G 3/3406 315/307
2009/0219244 A1 * 9/2009 Fletcher ..... G09G 3/3406 345/102
2009/0244048 A1 * 10/2009 Yamanaka ..... G09G 3/007 345/212
2009/0303170 A1 * 12/2009 Chung ..... G09G 3/3426 345/102
2010/0265280 A1 * 10/2010 Yen ..... G09G 3/3406 345/691
2011/0025713 A1 * 2/2011 McIntyre ..... G11B 27/105 345/636

(Continued)

*Primary Examiner* — Kumar Patel
*Assistant Examiner* — Vinh Lam
(74) *Attorney, Agent, or Firm* — McDermott Will & Emery LLP

(57) ABSTRACT

A computer-implemented method for automatically controlling a dynamic backlight control (DBC) of a display is disclosed according to one aspect of the subject technology. The method comprises determining whether an image to be displayed on the display comprises a high-resolution still image, and, if the image comprises a high-resolution still image, then disabling the DBC.

14 Claims, 3 Drawing Sheets

(56) References Cited

U.S. PATENT DOCUMENTS

| | | | | |
|---|---|---|---|---|
| 2011/0134142 | A1* | 6/2011 | Yamazaki | G09G 3/3648 345/634 |
| 2011/0157254 | A1* | 6/2011 | Yamazaki | G02F 1/13624 345/690 |
| 2011/0175894 | A1* | 7/2011 | Wakimoto | G09G 3/3648 345/212 |
| 2011/0187758 | A1* | 8/2011 | Miyake | G09G 3/3648 345/690 |
| 2011/0267381 | A1* | 11/2011 | Yamazaki | G09G 3/3607 345/690 |
| 2011/0304657 | A1* | 12/2011 | Yamamura | G09G 3/3426 345/690 |
| 2012/0033151 | A1* | 2/2012 | Toyotaka | G02F 1/134336 349/43 |
| 2012/0182332 | A1* | 7/2012 | Liu | G09G 3/2007 345/691 |
| 2012/0194480 | A1* | 8/2012 | Tateuchi | G06F 3/0421 345/175 |
| 2012/0200484 | A1* | 8/2012 | Sankar | G09G 3/3406 345/102 |
| 2012/0218175 | A1* | 8/2012 | Uemura | G09G 3/3406 345/102 |
| 2012/0265844 | A1* | 10/2012 | Chen | G06F 17/30873 709/217 |
| 2013/0009857 | A1* | 1/2013 | Tchoukaleysky | G09G 3/3406 345/102 |
| 2013/0088479 | A1* | 4/2013 | Kim | G09G 3/3614 345/212 |

* cited by examiner

DYNAMIC BACKLIGHT CONTROL SELECTOR

FIELD

The subject disclosure generally relates to displays, and, in particular, to dynamic backlight control of displays.

BACKGROUND

A liquid crystal display (LCD) may be illuminated by a backlight located behind a transmissive liquid crystal layer. The LCD may electronically control the transmittance of the backlight through each pixel of the liquid crystal layer to create an image on the screen. To conserve power, a dynamic backlight control (DBC) may be employed. The DBC may dynamically adjusts the brightness of the backlight based on the content of an image to be displayed on the LCD. For example, the DBC may reduce the brightness of the backlight (i.e., dim the backlight) when an overall gray shade of an image is lower (i.e., the image is darker), thereby conserving power.

SUMMARY

A computer-implemented method for automatically controlling a dynamic backlight control (DBC) of a display is disclosed according to one aspect of the subject technology. The method comprises determining whether an image to be displayed on the display comprises a high-resolution still image, and, if the image comprises a high-resolution still image, then disabling the DBC.

A machine-readable medium comprising instructions stored therein is disclosed according to an aspect of the subject technology. The instructions, which when executed by a machine, cause the machine to perform operations for automatically controlling a dynamic backlight control (DBC) of a liquid crystal display (LCD). The operations comprise determining whether an image to be displayed on the LCD comprises a high-resolution still image, and, if the image comprises a high-resolution still image, then disabling the DBC. The operations also comprise, if the image does not comprise a high-resolution still image, then enabling the DBC, wherein the DBC dynamically adjusts a brightness of a backlight of the LCD based on content of the image.

A system for automatically controlling a dynamic backlight control (DBC) of a display is disclosed according to one aspect of the subject technology. The system comprises one or more processors, and a machine-readable medium comprising instructions stored therein, which when executed by the one or more processors, cause the one or more processors to perform operations. The operations comprise determining whether an image to be displayed on the display comprises a high-resolution still image, and, if the image comprises a high-resolution still image, then disabling the DBC. The operations also comprise, if the image does not comprise a high-resolution still image, then enabling the DBC, wherein the DBC dynamically adjusts a brightness of a backlight of the display.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
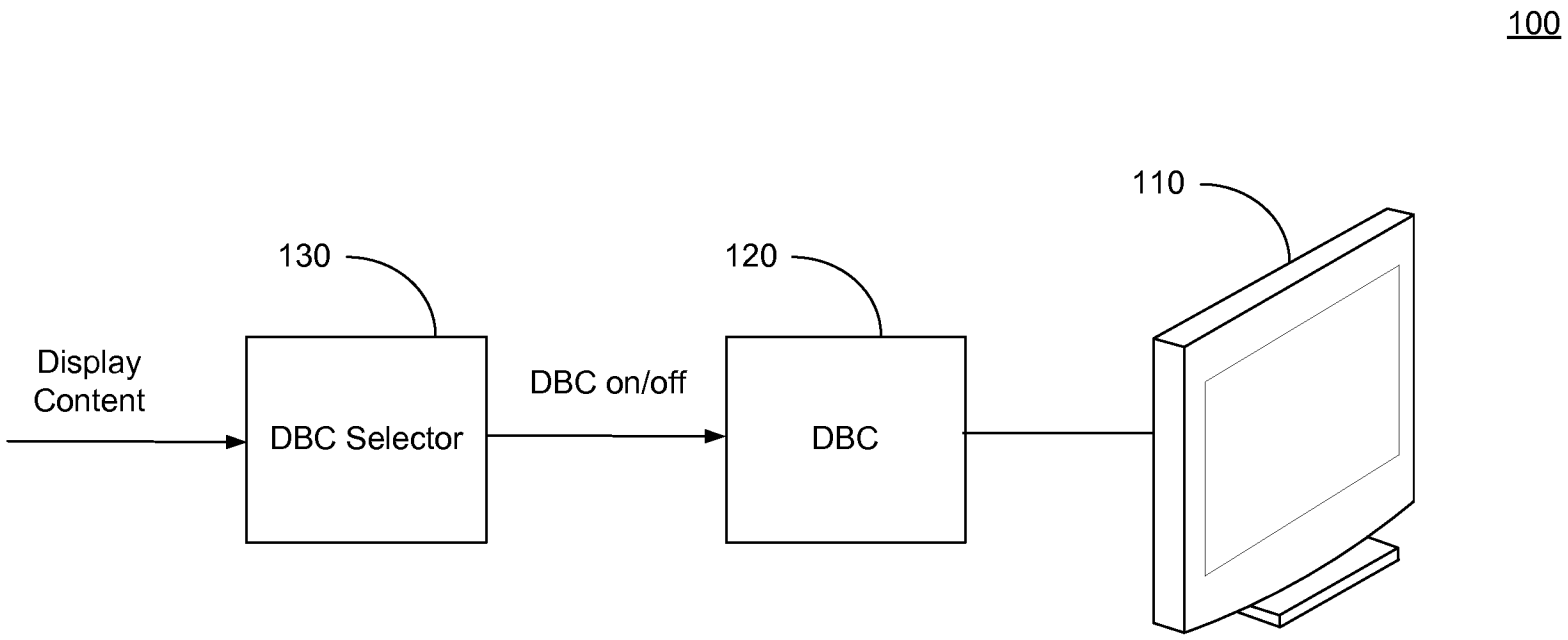
FIG. 1 shows a dynamic backlight control (DBC) selector according to one aspect of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

A liquid crystal display (LCD) may be illuminated by a backlight located behind a transmissive liquid crystal layer. The LCD may electronically control the transmittance of the backlight through each pixel of the liquid crystal layer to create an image on the screen. To conserve power, a dynamic backlight control (DBC) may be employed. The DBC dynamically adjusts the brightness of the backlight based on the content of an image to be displayed on the LCD. For example, the DBC may reduce the brightness of the backlight (i.e., dim the backlight) when an overall gray shade of an image is lower (i.e., the image is darker), thereby conserving power.

The DBC may also adjust a gamma value of the LCD, in which the gamma value specifies a non-linear relationship between an encoded gray shade value (brightness value) of a pixel in the image and the luminance of the pixel on the screen. The gamma value is typically 2.2 for an LCD with a constant backlight brightness. The DBC may reduce the gamma value of the LCD when the overall gray shade of an image is lower, e.g., by dynamically adjusting transmittance through the liquid crystal layer.

While reducing power consumption by the LCD, the DBC may reduce the gray-shade dynamic range of an image on the screen. This may result in an undesirable washout effect in a high-resolution still image with a broad gradient.

To address this problem, the subject technology automatically disables the DBC in cases where DBC may degrade the user experience. In one aspect, the subject technology determines whether a high-resolution still image is to be displayed on the LCD. If a determination is made that a high-resolution still image is to be displayed, then the DBC is automatically disabled.

On the other hand, the DBC may be enabled when moving images (e.g., video) are displayed on the LCD. This is because the loss of gray-shade dynamic range is much less perceptible to the human eye for moving images (e.g., video) than a still image, and therefore may not cause a noticeable degradation in the user experience. The DBC may also be enabled when text is displayed on the LCD. Thus, the subject technology may disable the DBC when a high-resolution still image is displayed on the LCD to avoid washout of the still image, while enabling the DBC for moving images and text to conserve power.

FIG. 1 shows an LCD 110, a DBC 120 and a DBC selector 130 according to an aspect of the subject technology. The DBC 120 is configured to dynamically adjust the backlight of the LCD 110, as discussed above. The DBC selector 130 is configured to automatically switch the DBC 120 on and off based on content to be displayed on the LCD 110. In one aspect, the DBC selector 130 may determine whether a high-resolution still image is to be displayed on the LCD 110. The DBC selector 130 may determine whether an image is still based on the extension (e.g., jpeg, bmp, tiff, etc.) and/or header of the corresponding image file. The DBC selector 130 may also determine whether the image is high-resolution (e.g., based on whether the number of pixels in the image exceeds a predetermined number of pixels). If the DBC selector 130 determines that a high-resolution still image is to be displayed on the LCD 110, then the DBC selector 130 may disable the DBC 120. When the DBC 120 is disabled, the brightness of the LCD backlight may be kept at a constant level. Otherwise, the DBC selector 130 may enable the DBC 120.

In one aspect, the DBC selector 130 may receive an image to be displayed on the LCD 110. The DBC selector 130 may first determine whether the image is a still image (i.e., not an image of a video). To do this, the DBC selector 130 may examine the extension and/or header of the corresponding image file. If the extension and/or header is indicative of a still image, then the DBC selector 130 may determine that the image is a still image. For example, the DBC selector 130 may determine that the image is a still image when the extension and/or header indicates that the corresponding file is a joint photographic experts group (jpeg) file, a tagged image format file (tiff), a bitmap (bmp) file, or other file type indicative of a still image. The DBC selector 130 may determine that the image is not a still image when the extension and/or header of the corresponding file is indicative of a video, such as a moving picture experts group (mpeg) file, or the image is part of a video data stream. If the DBC selector 130 determines that the image is a still image, then the DBC selector 130 may determine whether the image is a high-resolution image. Otherwise, the DBC selector 130 may leave the DBC 120 on if it is already on or switch the DBC 120 on if it is off.

The DBC selector 130 may determine whether a still image is a high-resolution still image by determining the number of pixels in the image and comparing the number of pixels to a predetermined number of pixels. If the number of pixels in the image is equal to or exceeds the predetermined number of pixels, then the DBC selector 130 may determine that the still image is a high-resolution still image. In this case, the DBC selector 130 may switch the DBC 120 off if it is not already off. If the number of pixels in the image is less than the predetermined number of pixels, then the DBC selector 130 may leave the DBC 120 on if it is already on or switch the DBC 120 on if it is off. The predetermined number of pixels may be determined empirically, for example, by determining the number of pixels at which a human observer notices a significant improvement in the gray-shade dynamic range for a still image with the DBC 120 switched off compared with the DBC 120 switched on.

The DBC selector 130 may determine the number of pixels in any one of a number of different ways. For example, the image file associated with an image may specify the number of pixels in the image. In another example, the image file may specify the number of pixels along the height of the image and the number of pixels along the width of the image. In this case, the DBC selector 130 may determine the total number of pixels by multiplying the number of pixels along the height of the image with the number of pixels along the width of the image.

In one aspect, the DBC selector 130 may only use the number of pixels along one dimension of the image to determine whether a still image is high resolution (e.g., to reduce computational load). For example, the DBC selector 130 may only use the number of pixels along the height of the image (i.e., number of pixels in the vertical direction). In this example, the DBC selector 130 may determine that the image is a high-resolution image when the number of pixels along the height of the image is equal to or exceeds a predetermined number of pixels in the vertical direction.

In another aspect, the DBC selector 130 may compare the number of pixels along the height of the image to a first threshold (i.e., first number of pixels) and compare the number of pixels along the width of the image to a second threshold (i.e., second number of pixels). In this aspect, the DBC selector 130 may determine that the image is a high-resolution image when both the number of pixels along the height is equal to or exceeds the first threshold and the number of pixels along the width is equal to or exceeds the second threshold. Otherwise the DBC selector 130 may determine that the image is not a high-resolution image for purposes of switching the DBC 120 on or off.

In another aspect, the resolution of an image may be represented as a number of pixels per unit length (e.g., inch) or number of pixels per unit area (e.g., square inch). In this aspect, the DBC selector 130 may compare the number of pixels per unit length of the image with a predetermined number of pixels per unit length. The DBC selector 130 may determine that the image is a high-resolution image when the pixels per unit length of the image is equal to or exceeds the predetermined number of pixels per unit length. Similarly, the DBC selector 130 may compare the number of pixels per unit area of the image with a predetermined number of pixels per unit area. The DBC selector 130 may determine that the image is a high-resolution image when the pixels per unit area of the image is equal to or exceeds the predetermined number of pixels per unit area.

In yet another aspect, the DBC selector 130 may use the size of an image file as an approximation of the number of pixels in the corresponding image. The DBC selector 130 may determine the size of the image file from the header of the image file, and the size of the image file may be given in number of bits, bytes or other data unit. In this aspect, the DBC selector 130 may compare the size of the image file to a predetermined file size, and determine that the corresponding image is a high-resolution image when the size of the image file is equal to or exceeds the predetermined file size.

Figure 2:
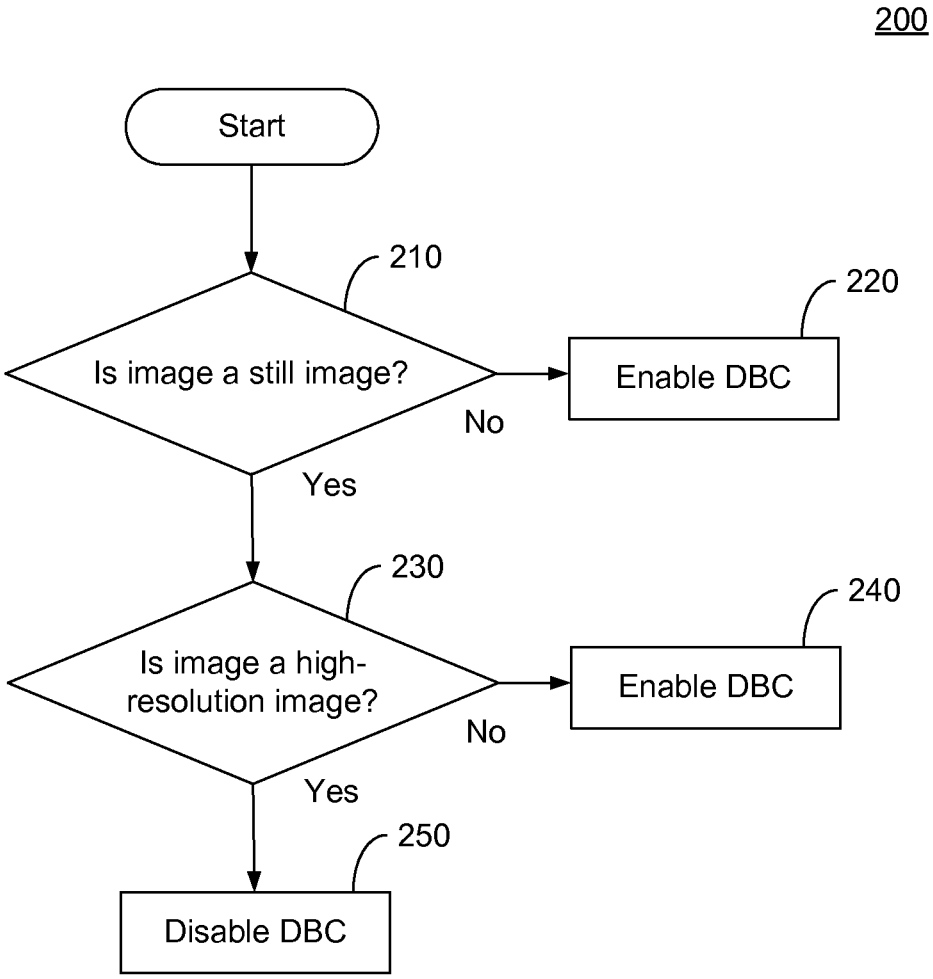
FIG. 2 shows a method for automatically controlling the dynamic backlight control (DBC) of a display according to one aspect of the subject technology.

FIG. 2 shows a method 200 for automatically controlling the dynamic backlight control (DBC) of a display according to an aspect of the subject technology.

In step 210, a determination is made whether an image to be displayed on the display is a still image. This may be done by examining an extension and/or header of an image file associated with the image. For example, a determination may be made that the image is a still image with the extension and/or header specifies a jpeg file, a tiff file or other file type indicative of a still image. If the image is determined to be a still image, then the method 200 proceeds to step 230. Otherwise, the DBC is enabled in step 220. This may involve leaving the DBC alone if it is already on or switching the DBC on if it is off.

In step 230, a determination is made whether the image is a high-resolution image. This may be done by determining whether the number of pixels in the image is equal to or exceeds a predetermined number of pixels and/or the size of a corresponding image file is equal to or exceeds a predetermined file size. If the image is determined to be a high-resolution image, then the DBC is disabled in step 250. This may involve switching the DBC off if the DBC is on or leaving the DBC off if it is already off. When the DBC is disabled, the backlight of the display may be kept at a constant level. If the image is not determined to be a high-resolution image, then the DBC is enabled in step 240. This may involve leaving the DBC alone if it is already on or switching the DBC on if it is off.

Thus, the method 200 in FIG. 2 disables the DBC when the image is both high-resolution and still. Those skilled in the art will appreciate that the subject technology is not limited to the specific order of steps shown in FIG. 2, and that the order of steps may be changed. For example, the order of steps 210 and 230 may be reversed.

Figure 3:
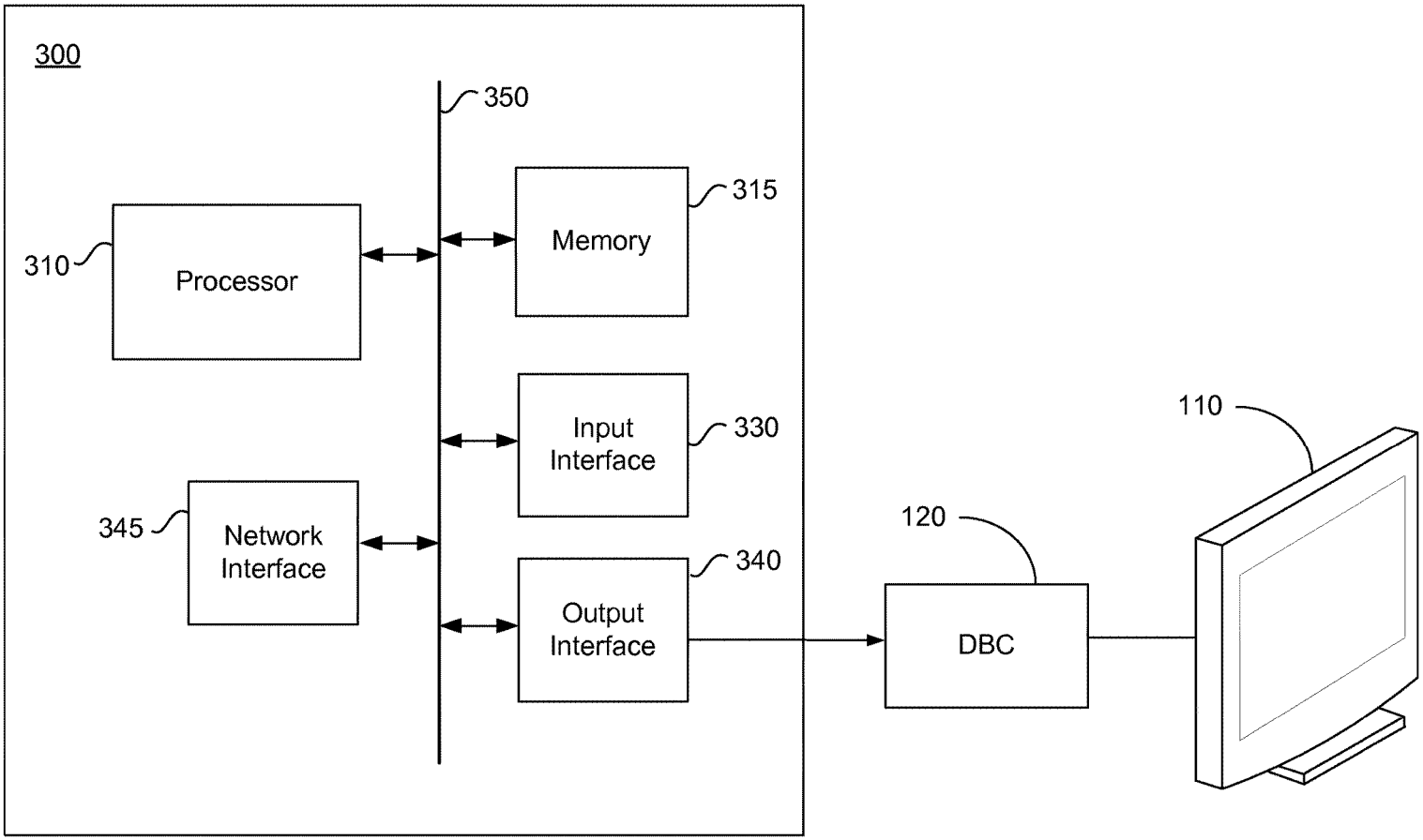
FIG. 3 conceptually illustrates a computing system with which some implementations of the subject technology may be implemented.

FIG. 3 shows a computing system 300 according to an aspect of the subject technology. While the computing system 300 is shown in one configuration in FIG. 3, it is to be understood that the computing system 300 may include additional, alternative and/or fewer components.

In the example shown in FIG. 3, the computing system 300 includes a processor 310, a memory 315, an input interface 330, an output interface 340, a network interface 345, and a bus 350. The bus 350 collectively represents all system, peripheral, and chipset buses that communicatively connect the numerous components of the computing system 300. For instance, the bus 380 communicatively connects the processor 310 with the memory 315. The processor 310 may retrieve instructions from the memory 315 and execute the instructions to implement processes according to various aspects of the subject technology. For example, the processor 310 may execute instructions to implement the DBC selector 130. The processor 310 may comprise a single processor or a multi-core processor in different implementations. The processor 310 may also comprise a graphical processing unit (GPU).

The memory 315 may comprise one or more memory units including non-volatile memory and volatile memory. For example, the memory 315 may include non-volatile memory for storing firmware, an operating system (OS), applications, and/or files. The memory 315 may also include volatile memory (e.g., a random access memory) for storing instructions and data that the processor 310 needs at runtime.

The input interface 330 enables a user to communicate information and commands to the computing system 300. For example, the input interface 330 may be coupled to a keyboard, keypad, and/or a pointing device (e.g., mouse or touch pad) to receive commands from the user. In another example, the input interface 330 may be coupled to a touch screen that receives commands from the user by detecting the presence and location of a user's finger/hand or stylus on the touch screen. The received commands may be sent to the processor 310 for processing.

The network interface 345 enables the computing system 300 to communicate with a network, for example, a local area network ("LAN"), a wide area network ("WAN"), an intranet, the Internet. The network interface 345 may include a wireless communication module for communicating with the network over a wireless link (e.g., WiFi wireless link, cellular wireless link, etc.).

The output interface 340 is configured to output content (e.g., images) from the processor 310 to LCD 110 for display to the user. The content may go through the DBC 120, which, when enabled, may dynamically adjust the backlight of the LCD 110 according to the gray levels of pixels in an image and/or other attribute of the pixels in the image. For example, the DBC 120 may reduce the brightness of the backlight (i.e., dim the backlight) when an overall gray shade of an image is lower (i.e., the image is darker). When the DBC 120 is disabled, the brightness of the backlight may be kept at a constant value. Also, the gamma value of the LCD 110 may be at a certain level (e.g., gamma of 2.2) when the DBC 120 is disabled and may be reduced from this level when the DBC 120 is enabled.

Although the DBC 120 is shown as being separate from the processor 310 in FIG. 3, it is to be appreciated that the DBC 120 may be implemented in the processor 310 by having the processor 310 execute instructions to perform the operations of the DBC 120.

As discussed above, the DBC selector 130 may be implemented in the processor 310 by having the processor 310 execute instructions to perform the operations of the DBC selector 130. In this aspect, the processor 310 may enabled/disable the DBC 120 via the output interface 340 based on whether a still high-resolution image is to be displayed on the LCD 110.

Many of the above-described features and applications may be implemented as a set of machine-readable instructions stored on a machine readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this disclosure, the term "software" is meant to include firmware or applications stored in a memory, which can be executed by a processor. Also, in some implementations, multiple software aspects can be implemented as sub-parts of a larger program while remaining distinct software aspects. In some implementations, multiple software aspects can also be implemented as separate programs. Finally, any combination of separate programs that together implement a software aspect described here is within the scope of the disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computers and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device, e.g., a LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

It is understood that any specific order or hierarchy of steps in the processes disclosed is an illustration of exemplary approaches. Based upon design preferences, it is understood that the specific order or hierarchy of steps in the processes may be rearranged, or that all illustrated steps be performed. Some of the steps may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the disclosure.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims.

Moreover, nothing disclosed herein is intended to be dedicated to the public regardless of whether such disclosure is explicitly recited in the claims.

What is claimed is:

1. A computer-implemented method for automatically controlling a dynamic backlight control (DBC) of a display, the method comprising:

determining whether an image to be displayed on the display comprises a still image and not a video image, based on a file extension or a file header for an image file of the image;

determining, in response to determining that the image is a still image, whether the still image comprises a high-resolution still image;

in response to determining that the still image comprises a high-resolution still image, disabling the DBC, wherein a backlight of the display is turned on and kept at approximately a constant brightness when the DBC is disabled; and in response to determining that the image is not a still image or that the still image does not comprise a high-resolution still image, enabling the DBC, wherein the backlight of the display is turned on while the DBC dynamically adjusts a turned-on brightness of the backlight of the display based on content of the image when the DBC is enabled.

2. The method of claim 1, wherein determining whether the still image comprises a high-resolution still image comprises determining that the still image is a high-resolution still image when the image has a resolution exceeding a resolution threshold.

3. The method of claim 1, wherein determining whether the still image comprises a high-resolution still image comprises determining that the still image is a high-resolution image when an image file corresponding to the image has a file size exceeding a certain file size.

4. The method of claim 1, wherein determining whether the image comprises a still image and not a video image based on the file extension or the file header for the image file of the image comprises determining that the image is a still image and not a video image when the file extension or the file header specifies one of a joint photographic experts group (jpeg) file, a tagged image format file (tiff), and a bitmap (bmp) file.

5. The method of claim 1, wherein the display comprises a liquid crystal display (LCD).

6. A computer-readable storage medium comprising instructions stored therein, which when executed by a machine, cause the machine to perform operations for automatically controlling a dynamic backlight control (DBC) of a liquid crystal display (LCD), the operations comprising:

determining whether an image to be displayed on the LCD comprises a still image and not a video image when the image is from an image file having a file extension or a file header indicative of a still image;

determining, in response to determining that the image is a still image, whether the still image comprises a high-resolution still image;

in response to determining that the still image comprises a high-resolution still image, disabling the DBC, wherein a backlight of the LCD is turned on and kept at approximately a constant brightness when the DBC is disabled; and in response to determining that the image is not a still image or that the still image does not comprise a high-resolution still image, enabling the DBC, wherein the backlight of the LCD is turned on while the DBC dynamically adjusts a turned-on brightness of the backlight of the LCD based on content of the image when the DBC is enabled.

7. The computer-readable storage medium of claim 6, wherein determining whether the still image comprises a high-resolution still image comprises determining that the still image is a high-resolution still image when the image has a resolution exceeding a resolution threshold.

8. The computer-readable storage medium of claim 6, wherein determining whether the still image comprises a high-resolution still image comprises determining that the still image is a high-resolution image when an image file corresponding to the image has a file size exceeding a certain file size.

9. The computer-readable storage medium of claim 6, wherein determining whether the image comprises a still image and not a video image when the image is from the image file having the file extension or the file header indicative of the still image comprises determining that the image is a still image when the file extension or the file header specifies one of a joint photographic experts group (jpeg) file, a tagged image format file (tiff), and a bitmap (bmp) file.

10. A system for automatically controlling a dynamic backlight control (DBC) of a display, the system comprising:

one or more processors; and a machine-readable medium comprising instructions stored therein, which when executed by the one or more processors, cause the one or more processors to perform operations comprising:

determining whether an image to be displayed on the display comprises a still image and not a video image, based on a file extension or a file header of an image file for the image;

determining, in response to determining that the image is a still image, whether the still image comprises a high-resolution still image;

in response to determining that the still image comprises a high-resolution still image, disabling the DBC, wherein a backlight of the display is turned on and kept at approximately a constant brightness when the DBC is disabled; and in response to determining that the image is not a still image or that the still image does not comprise a high-resolution still image, enabling the DBC, wherein the backlight of the display is turned on while the DBC dynamically adjusts a turned-on brightness of the backlight of the display when the DBC is enabled.

11. The system of claim 10, wherein determining whether the still image comprises a high-resolution still image comprises determining that the still image is a high-resolution still image when the image has a resolution exceeding a resolution threshold.

12. The system of claim 10, wherein determining whether the still image comprises a high-resolution still image comprises determining that the still image is a high-resolution still image when the image file corresponding to the image has a file size exceeding a certain file size.

13. The system of claim 10, wherein determining whether the still image comprises a high-resolution still image comprises determining that the still image is a high-resolution image when a number of pixels in the image exceeds a certain number of pixels.

14. The system of claim 10, wherein the DBC dynamically adjusts the backlight of the display based on content of the image.

* * * * *